US005300387A

United States Patent [19]

Ong

[11] Patent Number: 5,300,387

[45] Date of Patent: Apr. 5, 1994

[54] TONER COMPOSITIONS WITH NEGATIVE CHARGE ENHANCING ADDITIVES

[75] Inventor: Beng S. Ong, Mississauga, Canada

[73] Assignee: Xerox Corporation, Stamford, Conn.

[21] Appl. No.: 894,690

[22] Filed: Jun. 5, 1992

[51] Int. Cl.[5] ..... G03G 9/097

[52] U.S. Cl. ..... 430/110

[58] Field of Search ..... 430/110

[56] References Cited

U.S. PATENT DOCUMENTS 4,206,064 6/1980 Kiuchi et al. ..... 430/106
4,298,672 11/1981 Lu ..... 430/108
4,403,027 9/1983 Ishikawa et al. ..... 430/110
4,407,924 10/1983 Senshu et al. ..... 430/110 X
4,411,974 10/1983 Lu et al. ..... 430/106
4,845,003 7/1989 Kiriu et al. ..... 430/110

*Primary Examiner*—Roland Martin
*Attorney, Agent, or Firm*—E. O. Palazzo

[57] ABSTRACT

A negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid.

25 Claims, No Drawings

TONER COMPOSITIONS WITH NEGATIVE CHARGE ENHANCING ADDITIVES

BACKGROUND OF THE INVENTION

The invention is generally directed to toner and developer compositions, and more specifically, the present invention is directed to toner and developer compositions containing charge enhancing additives, which impart or assist in imparting a negative charge to the toner particles and enable toners with rapid triboelectric charging characteristics. In one embodiment, there are provided in accordance with the present invention toner compositions comprised of a polymer, or polymer resins, pigment, including color pigment particles or dye molecules, and certain metal complex composites which serve as a charge enhancing additive. In one embodiment, the present invention is directed to toner compositions with metal complex charge enhancing additives, which additives can be obtained from the reaction of a mixture of hydroxyaromatic compound like hydroxybenzoic acid, and a base with a mixture of a metal ion and an excess of an aromatic dicarboxylic acid. The metal complex charge enhancing additives in embodiments are believed to be comprised of or contain a metal complex component comprised of an anion with a central metal ion bonded to two different ligands, one hydroxybenzoic acid and one an aromatic dicarboxylic acid, and a counter cation of a proton, an alkaline metal ion or an ammonium ion. When an ortho-hydroxybenzoic acid and an aromatic ortho-dicarboxylic acid such as phthalic acid are employed as the two ligand precursors, the resulting effective metal complex component contains an anion structure in which the two ligands are chelated to the central metal in a bidentate manner. The charge additives in embodiments of the present invention enable, for example, toners with rapid triboelectric charging characteristics, extended developer life, stable triboelectric properties substantially irrespective of changes in environmental conditions, and high image print quality with substantially no background deposits. Also, the aforementioned toner compositions usually contain a colorant component comprised of, for example, carbon black, magnetites, or mixtures thereof, color pigments or dyes with cyan, magenta, yellow, blue, green, red, or brown color, or mixtures thereof thereby providing for the development and generation of black and/or colored images. The toner and developer compositions of the present invention can be selected for electrophotographic, especially xerographic imaging and printing processes, including highlight and full color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003 there are illustrated negatively charged toners with certain aluminum salt charge additives. More specifically, this patent discloses as charge additives aluminum complexes comprised of two or three hydroxybenzoic acid ligands bonded to one central aluminum ion. While these charge additives have the capability of imparting negative charge to toner particles, they are generally not as efficient in promoting the rate of triboelectric charging of toner particles. A fast rate of triboelectric charging is particularly important for high speed xerographic machines because they consume toners rapidly, and fresh toners have to be constantly added to keep the machines running. The added uncharged toners are, therefore, required to charge up to their equilibrium triboelectric charge level rapidly to ensure no interruption in the xerographic machine's operation. Another shortcoming of these charge additives is their thermal instability, and they often decompose during the thermal extrusion process of the toner manufacturing cycle. Additionally, the hydroxybenzoic acid ligands, particularly 3,5-di-tert-butylsalicylic acid, are costly; for research quantities, that is 1 kilogram or less, the cost of 3,5-di-tert-butylsalicylic acid is $250 per kilogram as compared to about $30 per kilogram for phthalic acid. About 50 percent less of 3,5-di-tert-butylsalicylic acid precursor can be selected for the preparation of the charge additive of the present invention, and the other 50 percent, or ½ replaced with phthalic acid precursor in embodiments. Many of the above disadvantages are eliminated, or substantially eliminated with the metal complex charge additives of the present invention.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, discloses developer compositions containing as charge enhancing additives organic sulfate and sulfonates, which additives can impart a positive charge to the toner composition; and U.S. Pat. No. 4,298,672, the disclosure of which is totally incorporated herein by reference, discloses positively charged toner compositions with resins and pigment particles, and as charge enhancing additives alkyl pyridinium compounds.

Disclosed in copending patent application, U.S. Ser. No. 894,688, the disclosure of which is totally incorporated herein by reference, is a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol.

Although many charge enhancing additives are known, there continues to be a need for charge enhancing additives which when incorporated into, or on toner compositions, provide toners with many of the advantages illustrated herein. There is also a need for negative charge enhancing additives which are useful for incorporation into black and colored toner compositions and which can be utilized for developing positive electrostatic latent images. Moreover, there is a need for colored toner compositions containing charge enhancing additives which do not substantially interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can therefore form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negatively charged toner compositions which have desirable triboelectric charge levels of, for example, from between about −10 to about −40 microcoulombs per gram, and preferably from about −15 to about −25 microcoulombs per gram, and triboelectric charging rates of less than about 120 seconds, and preferably less than 60 seconds as measured by standard charge spectrograph methods when the toners are frictionally charged against suitable carrier particles via conventional roll-milling techniques. There is also a need for nontoxic, substantially nontoxic, or environmentally compatible charge enhancing additives that can be incorporated at effective concentrations of, for example, less than 7 weight percent, and preferably less than 4 weight percent in toner compositions. The concentrations of the charge additives that can be utilized in embodiments generally ranges from about 0.05 weight percent to about 10 weight percent depending on whether the charge additive is utilized as a surface additive or as a dispersion in the bulk of the toner. An additional need resides in the provision of simple and cost-effective preparative processes for the metal complex composite charge enhancing additives of the present invention. Concentrations of toner in the developer (toner and carrier) particles are, for example, from about 0.5 to about 5 weight percent, and preferably from about 1 to about 3 weight percent.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

In yet a further object of the present invention there may be provided, it is believed, humidity insensitive, from about, for example, 20 to 80 percent relative humidity at temperatures of from 60° to 80° F. as determined in a relative humidity testing chamber, negatively charged toner compositions with desirable triboelectric charging rates of less than 120 seconds, preferably less than 60 seconds, and in embodiments from about 15 to about 30 seconds as determined by the known charge spectrograph, and acceptable triboelectric charging levels of from about −10 to about −40 microcoulombs per gram.

Another object of the present invention resides in the preparation of negatively charged toners which will enable the development of images in electrophotographic imaging apparatuses, which images have substantially no background deposits thereon, are substantially smudge proof or smudge resistant, and therefore are of excellent resolution; and further such toner compositions can be selected for high speed electrophotographic apparatuses, that is those exceeding 50 copies per minute.

A further object is to provide a simple and cost-effective preparative process for the metal complex composite charge enhancing additives.

These and other objects of the present invention can be accomplished in embodiments thereof by providing toner compositions comprised of a polymer, or polymer resins, colorants comprised of color pigment particles or dye molecules, and certain metal complex composite charge additives derived, for example, from the reaction of a mixture of a hydroxybenzoic acid and a base with a mixture of a metal ion and an aromatic dicarboxylic acid. More specifically, the present invention in embodiments is directed to toner compositions comprised of polymer, pigment, or dye, and a negative metal complex charge enhancing additive containing an active component whose structure is believed to be essentially represented by the following formula:

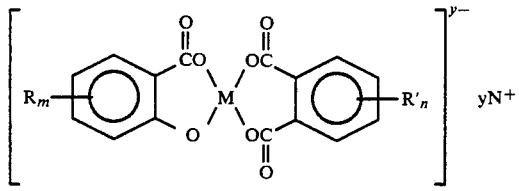

wherein M is a metal; $N^+$ is the counter cation; R and R′ are substituents such as alkyl, alkoxy, aryloxy, halogen, carbonyl group, alkoxycarbonyl group, amino group, nitro group or mixtures thereof, and the like; m and n represent the number of R and R′ substituents, and can be a number of from 0 to 3; $y^-$ represents the negative charge magnitude of the cation and can be the numbers 1 or 2; and y represents the number of counter cations $N^+$.

Illustrative examples of the substituents R and R′ are alkyl groups containing from about 1 carbon atom to 25 carbon atoms such as methyl, ethyl, propyl, butyl, pentyl, cyclohexyl, and the like; alkoxy groups containing from 1 to about 25 carbon atoms such as methoxy, ethoxy, propoxy, butoxy and the like; aryloxy groups such as phenoxy, tolyloxy, anisyloxy, xylyloxy, chlorophenoxy, naphthyloxy, and the like; acyl groups such as acetyl, propionyl, butyryl, benzoyl, and the like; alkoxycarbonyl groups such as methoxycarbonyl, ethoxycarbonyl, propoxycarbonyl, butoxycarbonyl, and the like; halogen atoms such as fluorine, chloride, bromine and iodine; and amino groups such as amino, N-methylamino, N-ethylamino, N-propylamino, N-butylamino, N-pentylamino, N,N-dimethylamino, N-methyl-N-ethyl-amino, and the like. The central metal, M, is preferably selected from the group consisting of boron, aluminum, gallium, zinc, cadmium, mercury, nickel, cobalt, iron, manganese, chromium, magnesium, and calcium and more generally M can be as illustrated in the copending patent application mentioned herein; while the counter cation, $N^+$, is preferably selected from the group consisting of a proton, lithium ion, sodium ion, potassium ion, cesium ion, rubidium ion, ammonium ion, and substituted ammonium ion.

Illustrative examples of the metal complex charge enhancing components of the present invention are essentially as represented by formulas (I) through (X):

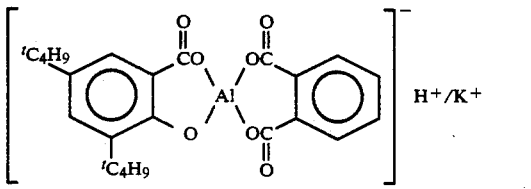
(I)

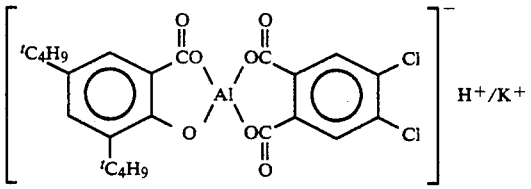
(II)

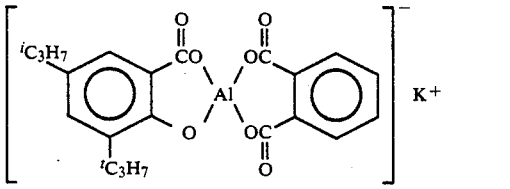
(III)

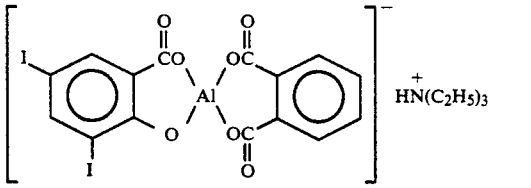
(IV)

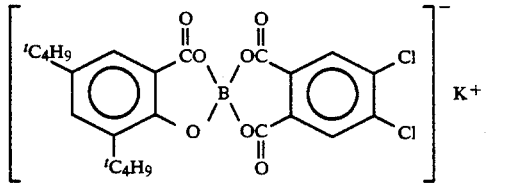
(V)

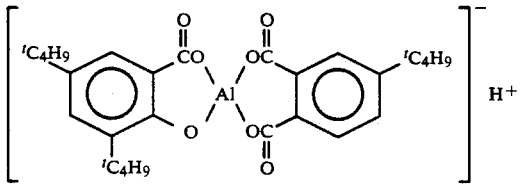
(VI)

-continued

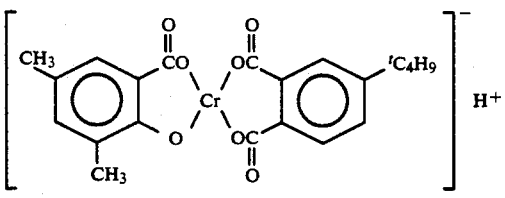
(VII)

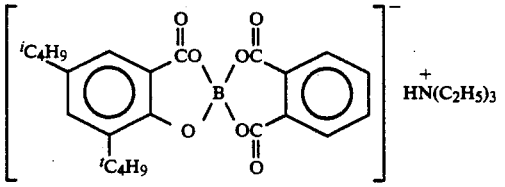
(VIII)

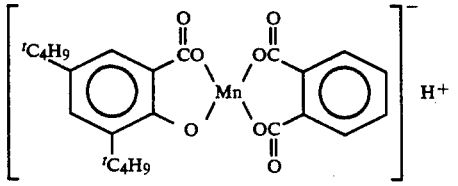
(IX)

or

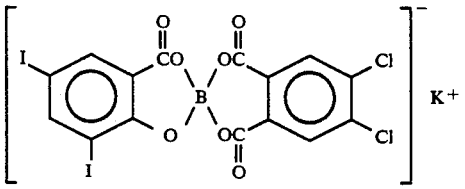
(X)

The aforementioned charge additives can be incorporated into the toner, may be present on the toner surface, or may be present on toner surface additives such as colloidal silica particles. Advantages of rapid triboelectric charging characteristics, appropriate triboelectric charge levels, and the like can be achieved with many of the aforementioned toners of the present invention. In another embodiment of the present invention there is provided, subsequent to known micronization and classification, toner particles with a volume average diameter of from about 5 to about 20 microns.

The metal complex charge additives of the present invention can be prepared by the reaction of a mixture of hydroxybenzoic acid and an alkaline or ammonium base with a metal ion and an excess of an aromatic dicarboxylic acid in an aqueous medium. The reaction is generally accomplished at a temperature between ambient temperature and the refluxing temperature of the reaction mixture for a duration ranging from 20 minutes to over 10 hours. More specifically, the preparation is accomplished by the dropwise addition of an aqueous solution of one molar equivalent of a hydroxybenzoic acid containing two or more molar equivalents of an alkaline or ammonium base to an aqueous solution of a molar equivalent of a metal ion and an excess of an aromatic dicarboxylic acid. The addition is generally effected over a period of 15 minutes to over two hours depending on the scale of the preparation. The pH of the reaction medium may be adjusted by adding alkaline or ammonium base depending on the nature of the central metal ion employed and the counter cation desired.

After the reaction, the resulting metal complex product is filtered and washed with water or dilute aqueous base. In embodiments of the present invention, the effective metal complex component obtained may contain a mixture of proton and alkaline metal ion or ammonium ion as the counter cations. In specific embodiments, the present invention is directed to metal complex composite charge enhancing additives derived from the reaction of a metal ion with an orthohydroxybenzoic acid (salicylic acid) and an aromatic ortho-dicarboxylic acid (phthalic acid) as the two ligand precursors.

The toner compositions of the present invention can be prepared by a number of known methods such as admixing and heating polymer resins such as styrene butadiene copolymers, colorants such as color pigment particles or dye compounds, and the aforementioned metal complex charge enhancing additive, or mixtures of charge additives in a concentration, preferably ranging from about 0.5 percent to about 5 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 5 to about 25 microns, and preferably of from about 5 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner polymer, or resins selected for the toner and developer compositions of the present invention include vinyl polymers such as styrene polymers, acrylonitrile polymers, vinyl polymers, vinyl ether polymers, acrylate and methacrylate polymers; epoxy polymers; polyurethanes; polyamides and polyimides; polyesters; and the like. The polymer resins selected for the toner compositions of the present invention include homopolymers or copolymers of two or more monomers. Furthermore, the above-mentioned polymer resins may also be crosslinked depending on the desired toner properties. Illustrative vinyl monomer units in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediols, propanediols, butanediols, pentanediols, pinacol, cyclopentanediols, hydrobenzoin, bis(hydroxyphenyl)alkanes, dihydroxybiphenyls, substituted dihydroxybiphenyls, and the like.

As one toner resin, there can be selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 07/814,641 (D/91117), and U.S. Pat. No. 15,227,460 (D/91117Q), the disclosures of which are totally incorporated herein by reference, can be selected as toner resins. Other specific toner resins include styrene-methacrylate copolymers, and styrene-butadiene copolymers; PLIOLITES ®. and suspension polymerized styrene-butadienes, reference U.S. Pat. No. 4,558,108, the disclosure of which is totally incorporated herein by reference. Also, waxes with a molecular weight of from about 1,000 to about 6,000 such as polyethylene, polypropylene, and paraffin waxes can be included in, or on the toner compositions as fuser roll release agents.

The polymer resins are present in a sufficient, but effective amount, for example from about 30 to about 95 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black, like REGAL 330 ®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK ®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas such as AEROSIL®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSILS®, like AEROSIL 972® available from Degussa Company can be surface treated with the metal complex composite charge additives of the present invention illustrated herein in an amount of from about 1 to about 50 weight percent and preferably 10 weight percent to about 25 weight percent followed by the addition thereof to the toners in an amount of from 0.1 to 10, and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commerically available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Carrier with polymer coatings not in close proximity in the triboelectric series can also be selected, reference U.S. Pat. Nos. 4,937,166 and 4,935,326, the disclosures of which are totally incorporated herein by reference, including for example coatings of KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 to about 1,000 microns, and preferably from between about 80 and 200 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods including extrusion melt blending the toner resins, colorants, and the metal complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be prepared, followed by addition of the charge enhancing additives and other optional surface additives, or the charge enhancing additive-treated surface additives such as colloidal silicas. Further, other methods of preparation for the toner are as illustrated herein.

The toner and developer compositions of the present invention may be selected for use in electrostatographic imaging and printing apparatuses containing therein conventional photoreceptors providing that they are capable, for example, of forming positive electrostatic latent images relative to the triboelectric charge polarity of the toners.

The toners of the present invention are usually jetted and classified subsequent to preparation to enable toner particles with a preferred volume average diameter of from about 5 to about 25 microns, and more preferably from about 5 to about 12 microns. The rates of triboelectric charging for the toners of the present invention are preferably less than 120 seconds, and more specifically, less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention. Comparative Examples are also presented.

EXAMPLE I

An aluminum complex charge enhancing additive derived from aluminum ion and 3,5-di-tert-butylsalicylic acid, and phthalic acid (I) was prepared as follows:

A mixture of 8.50 grams (12.5 millimoles) of aluminum sulfate octadecahydrate [$Al_2(SO_4)_3 \cdot 18H_2O$] and 4.57 grams (27.5 millimoles) of phthalic acid in 100 milliliters of water was mechanically stirred and heated to 90° C. in a 500 milliliter round-bottomed flask fitted with a water condenser. A solution of 3.5 grams of potassium hydroxide and 6.26 grams (25.0 millimoles) of 3,5-di-tert-butylsalicylic acid in 150 milliliters of water was then added dropwise at a rate of about 2 milliliters per minute over a period of about 75 minutes. The temperature of the reaction mixture was maintained at about 80° to 90° C. during addition. After the addition, the reaction mixture was stirred at the same temperature for another 2 hours, and then allowed to cool down to room temperature, about 25° C., before being filtered by suction filtration. The filtered precipitate was washed several times with deionized water, and then dried in vacuo at 80° C. for 48 hours. The yield of the aluminum product substantially as represented by Formula (I) and identified by analytical methods was 76 percent.

EXAMPLE II

An aluminum complex charge enhancing additive derived from 3,5-di-tert-butylsalicylic acid and 4,5-dichlorophthalic acid was prepared in accordance with the procedure of Example I except that 4,5-dichlorophthalic acid was utilized in place of phthalic acid. The yield of the aluminum product with the major component represented by Formula (II) was 73 percent.

EXAMPLE III

An aluminum complex charge enhancing additive derived from 3,5-di-iso-propylsalicylic acid and phthalic acid was prepared in accordance with the procedure of Example I except that 3,5-di-iso-propylsalicylic acid was utilized in place of 3,5-di-tert-butylsalicylic acid. In addition, the filtered aluminum product was washed with dilute aqueous potassium hydroxide solution until the washing was basic. The yield of the aluminum product substantially represented by Formula (III) was 78 percent.

EXAMPLE IV

There was prepared in an extrusion device, available as ZSK-30 from Werner Pfleiderer, a toner composition by adding thereto 94.0 weight percent of a suspension polymerized styrene butadiene resin (91/9), reference U.S. Pat. No. 4,558,108, the disclosure of which is totally incorporated herein by reference, and 6.0 weight percent of Regal 330® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface-coated with 0.25 weight percent of the aluminum complex composite charge enhancing additive of Example I by dry blending in a conventional dry blender for 60 seconds.

The above toner was equilibrated at 25° C. and 50 percent relative humidity in a temperature and humidity controlled chamber as illustrated herein for 24 hours. A developer was then prepared by blending 2.0 weight percent of the above prepared surface-treated toner with 98.0 weight percent of a carrier containing a nickel zinc ferrite core and 0.9 weight percent of a polymer composite coating comprised of 80 weight percent of a methyl terpolymer and 20 weight percent of VULCAN XC72R TM carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −31.1 microcoulombs per gram by the standard blow-off technique in a Faraday Cage apparatus. To measure the rate of triboelectric charging of toner, 1.0 weight percent of the above uncharged surface-treated toner was added to the time zero developer, and the charge distribution of the toner of the resulting developer was measured as a function of the blending time via roll milling using a charge spectrograph. The time required for the uncharged toner of the resulting developer to attain a charge distribution similar to that of the toner of the time zero developer was taken to be the rate of charging of the toner. For this toner, the rate of charging, or admix was about 30 seconds.

COMPARATIVE EXAMPLE (A)

A comparative black toner with a commercial charge enhancing additive, BONTRON E-88 TM an aluminum complex obtained from Orient Chemicals, was prepared by blending the untreated toner of Example IV with 0.25 weight percent of BONTRON E-88 TM, and a developer was then prepared from this toner in accordance with the procedure of Example IV. The toner exhibited a triboelectric charge of −40.4 microcoulombs per gram, and its rate of charging, or admix was about 5 minutes as measured by the procedure of Example IV.

EXAMPLE V

A black toner with the aluminum complex composite charge enhancing additive of Example II was prepared in accordance with the procedure of Example IV except that 0.10 weight percent of the aluminum complex composite charge enhancing additive of Example II was utilized in place of 0.25 weight percent of the aluminum complex of Example I. A developer was then prepared from this toner in accordance with the procedure of Example IV. The toner had a triboelectric charge of −28.2 microcoulombs per gram, and a rate of charging of about 60 seconds as measured by the procedure of Example IV.

COMPARATIVE EXAMPLE (B)

A comparative black toner with 0.10 weight percent of the commercial charge enhancing additive, BONTRON E-88 TM obtained from Orient Chemicals, was prepared by blending the untreated toner of Example IV with 0.10 weight percent of BONTRON E-88 TM, and a developer was then prepared from this toner in accordance with the procedure of Example IV. The toner exhibited a triboelectric charge level of −15.2 microcoulombs per gram, and its rate of charging was measured to be about 5 minutes.

EXAMPLE VI

A black toner with 0.25 weight percent of aluminum complex composite charge enhancing additive of Example III was prepared in accordance with the procedure of Example IV except that the aluminum complex composite charge enhancing additive of Example III was utilized in place of the metal complex of Example I. A developer was then prepared from this toner in accordance with the procedure of Example IV. The toner displayed a triboelectric charge of −22.9 microcoulombs per gram, and its rate of charging was measured to be about 60 seconds.

COMPARATIVE EXAMPLE (C)

A comparative black toner with 0.25 weight percent of the commercial charge enhancing additive, BONTRON E-84 TM obtained from Orient Chemicals, was prepared by blending the untreated toner of Example IV with 0.25 weight percent of BONTRON E-84 TM, and a developer was then prepared from this toner in accordance with the procedure of Example IV. The toner exhibited a triboelectric charge of −25.6 microcoulombs per gram, and its rate of charging was measured to be about 10 minutes.

EXAMPLE VII

A blue toner comprised of 98.0 weight percent of SPAR II polyester resin, 2.0 weight percent of PV FAST BLUE TM pigment, and 1.0 weight percent of the metal complex composite charge additive of Example I was prepared by melt blending these three components, followed by micronizing and classifying in accordance with the procedure of Example IV. The resulting toner had a volume average particle diameter of 9.3 microns, and a particle size distribution of 1.26. The toner was subsequently coated with 0.10 weight percent of aluminum complex of Example I, and a developer was prepared from this toner using 2.0 weight percent of toner and a carrier containing a steel core and 0.8 weight percent of a polymer composite coating comprised of 80 weight percent of polymethyl methacrylate and 20 weight percent of VULCAN XC72R TM carbon black. The toner displayed a triboelectric charge of −14.6 microcoulombs per gram, and its rate of charging was measured to be about 60 seconds.

COMPARATIVE EXAMPLE (D)

A comparative blue toner and developer composition with a commercial charge additive, BONTRON E-88 TM, were prepared in accordance with the procedure of Example VII except that BONTRON E-88 TM was utilized in place of the aluminum complex composite charge additive of Example I. The toner displayed a triboelectric charge of −9.2 microcoulombs per gram, and its rate of charging was about 5 minutes.

COMPARATIVE EXAMPLE (E)

Another comparative blue toner and developer were prepared using another commercial charge additive, BONTRON E-84 TM, by repeating the procedure of Example VII. The triboelectric charge of this toner was −12.8 microcoulombs per gram, and its rate of charging or admix was 10 minutes.

The charge additives of the present invention may in embodiments contain other components, reference for example the Examples, however, the major active component is as indicated. Also, BONTRON E-84 TM is believed to be the zinc complex of 3,5-di-t-butylsalicylic acid, and BONTRON E-88 TM is believed to contain about 67 percent of the aluminum material from 3,5-di-t-butylsalicylic acid mixed with 33 percent of 3,5-di-t-butylsalicylic acid.

Other modifications of the present invention may occur to those skilled in the art subsequent to a review of the present application, and these modifications, including equivalents thereof, are intended to be included within the scope of the present invention.

What is claimed is:

1. A negatively charged toner composition consisting essentially of a polymer or polymers, a colorant or colorants, optional surface additives, and a tetracoordinated metal complex charge enhancing additive obtained from the reaction of a hydroxybenzoic acid and a base with a mixture of a metal ion and an aromatic dicarboxylic acid; and wherein said metal complex charge additive contains two dissimilar ligands, and which complex is free of water.

2. A negatively charged toner consisting of a polymer or polymers, pigment, and an unsymmetrical tetracoordinated metal complex charge enhancing additive as essentially represented by the following formula

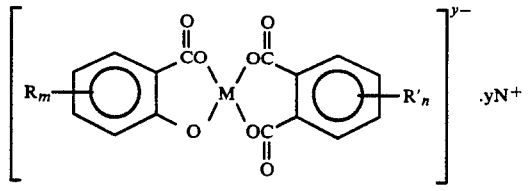

where M is the central metal ion; N+ is the counter cation; R and R′ are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; y− is the magnitude of the negative charge of the anion or the number of the counter cations of the metal complex, and represents the number 1 or 2; and y represents the number of counter cations N+; and wherein two dissimilar ligands are attached to the metal ion; and wherein said metal complex charge enhancing additive is free of water.

3. A toner in accordance with claim 1 wherein the metal complex charge additive contains a metal ion selected from the group consisting of aluminum, boron, gallium, zinc, cadmium, mercury, nickel, cobalt, iron, manganese, magnesium, calcium, chromium, and copper.

4. A toner in accordance with claim 1 wherein the metal complex charge additive is obtained from an orthohydroxybenzoic acid and an aromatic ortho-dicarboxylic acid.

5. A toner in accordance with claim 2 wherein the central metal, M, is selected from the group consisting of aluminum, boron, gallium, zinc, cadmium, mercury, nickel, cobalt, iron, manganese, magnesium, calcium, chromium, and copper; and R and R′ are alkyl, or alkoxy substituents.

6. A toner in accordance with claim 2 wherein the counter cation, N+, is selected from the group consisting of a proton, lithium ion, sodium ion, potassium ion, cesium ion, rubidium ion, ammonium ion, and an alkyl substituted ammonium ion.

7. A toner in accordance with claim 2 wherein the substituents R and R′ are tert-butyl groups.

8. A toner in accordance with claim 1 wherein the charge additive is present in an amount of from about 0.05 to about 5 weight percent.

9. A toner in accordance with claim 2 wherein the charge additive is incorporated into the toner, or is present on the surface of the toner composition.

10. A toner in accordance with claim 3 wherein the charge additive is contained on colloidal silica particles.

11. A toner in accordance with claim 1 wherein the toner's rate of charging is from about 15 seconds to about 120 seconds as determined by the standard charge spectrograph method using frictional charging against suitable carrier particles via roll milling.

12. A toner in accordance with claim 2 with a negative triboelectric charge of from between about −10 to about −40 microcoulombs per gram.

13. A toner in accordance with claim 2 wherein the polymer is selected from the group consisting of styrene polymers, acrylic polymers or methacrylic polymers, polyesters, and mixtures thereof.

14. A toner in accordance with claim 2 wherein the polymer or polymers are selected from the group consisting of styrene acrylates, styrene methacrylates, and styrene butadienes.

15. A toner in accordance with claim 1 containing a wax component which has a weight average molecular weight of from about 1,000 to about 6,000.

16. A toner in accordance with claim 15 wherein the waxy component is selected from the group consisting of polyethylene and polypropylene.

17. A toner in accordance with claim 2 containing surface additives selected from the group consisting of metal salts of a fatty acid, colloidal silicas, and mixtures thereof.

18. A toner in accordance with claim 2 wherein the pigment is selected from the group consisting of carbon black, magnetites, mixtures thereof, cyan, magenta, yellow, red, blue, green, brown pigments, and mixtures thereof.

19. A developer comprised of the toner composition of claim 1 and carrier particles.

20. A developer comprised of the toner composition of claim 2 and carrier particles.

21. A developer in accordance with claim 19 wherein the carrier particles are selected from the group consisting of ferrites, steel, an iron powder with a polymer, and mixture of polymers, coating thereover.

22. A developer in accordance with claim 21 wherein the coating is selected from the group consisting of a methyl terpolymer, a polyvinylidine fluoride, a polymethyl methacrylate, and a mixture of polymers not in close proximity in the triboelectric series.

23. A toner in accordance with claim 2 wherein the metal composite charge enhancing additive is represented by Formulas selected from the group consisting of (I), (II), (III), (IV), (V), (VI), (VII), (VIII), (IX) and (X), and wherein said metal complex charge enhancing additive is free of water.

24. A toner in accordance with claim 1 wherein the metal composite charge enhancing additive is represented by Formulas selected from the group consisting of (I), (II), (III), (IV), (V), (VI), (VII), (VIII), (IX) and (X), and wherein said metal complex charge enhancing additive is free of water.

25. A toner and developer composition in accordance with claim 2 wherein the metal complex composite charge enhancing additive with an active component as represented by Formula (IV) is utilized.

* * * * *